US005644887A

United States Patent [19]

Gerhaher et al.

[11] Patent Number: 5,644,887

[45] Date of Patent: Jul. 8, 1997

[54] EXTRUDED FACADE TILE

[76] Inventors: Max Gerhaher, Dr.-Aicher-Strasse 3, 94405 Landau, Germany; Franz Gerhaher, Stadtgraben 20, 94315 Straubing, Germany

[21] Appl. No.: 282,615

[22] Filed: Jul. 29, 1994

[30] Foreign Application Priority Data

Aug. 2, 1993 [DE] Germany ..... 43 25 873.5

[51] Int. Cl.[6] ..... E04F 13/00

[52] U.S. Cl. ..... 52/606; 52/609; D25/114

[58] Field of Search ..... 52/606, 609, 592.5, 52/592.6, 439, 503, 506.02, 506.03, 415, 384, 385, 386, 387, 388, 389; D25/114, 115, 118

[56] References Cited

U.S. PATENT DOCUMENTS

| | | | |
|---|---|---|---|
| 1,424,372 | 8/1922 | Neese et al. | 52/609 |
| 1,530,217 | 3/1925 | Stevens | 52/503 |
| 1,709,035 | 4/1929 | Payne | 52/439 X |
| 1,807,138 | 5/1931 | Spelshouse | 52/439 X |
| 2,078,069 | 4/1937 | Eliel | 52/384 X |
| 2,086,989 | 7/1937 | Raad | 52/606 X |
| 2,198,399 | 4/1940 | Tefft | 52/606 X |
| 2,737,801 | 3/1956 | Barnhart | D25/115 X |
| 2,810,286 | 10/1957 | Barnhart | 52/606 X |
| 4,157,408 | 6/1979 | Lingl | 427/209 |
| 4,229,123 | 10/1980 | Heinzmann | 52/606 X |
| 4,510,725 | 4/1985 | Wilson | 52/606 X |

FOREIGN PATENT DOCUMENTS

| | | | |
|---|---|---|---|
| 493985 | 6/1950 | Belgium | 52/439 |
| 1096057 | 6/1955 | France | 52/606 |
| 1522451 | 3/1968 | France | 52/384 |
| 425874 | 3/1926 | Germany | 52/609 |
| 3636565 | 5/1988 | Germany | 52/384 |
| 3734872 | 4/1989 | Germany | 52/415 |
| 3401271 | 5/1991 | Germany . | |
| 418781 | 3/1947 | Italy | 52/592.6 |
| 839253 | 6/1960 | United Kingdom | 52/98 |

*Primary Examiner*—Carl D. Friedman
*Assistant Examiner*—Laura A. Saladino
*Attorney, Agent, or Firm*—Morgan & Finnegan, L.L.P.

[57] ABSTRACT

The invention relates to extruded ceramic tiles for exterior walls which can be used for constructional purposes or for decorative purposes. The tiles have holes extending in the direction of the extrusion of the tile and possesses a relatively low weight. The instant tiles can be adapted to size in a stepless manner without any cut intersecting even one of the holes or one of the grooves and have satisfactory draining of water. They are simple and economic to produce. The marginal webs of the instant tiles are arranged between the marginal surfaces of the tile extending in parallelism to the holes and the marginal holes possess a width at least twice that of the internal webs of the tiles.

8 Claims, 4 Drawing Sheets

EXTRUDED FACADE TILE

FIELD OF THE INVENTION

The invention relates to an extruded and preferably ceramic exterior wall or facade tile as claimed in claim 1 for back ventilated bracket mounting on a support structure or for attachment by means of bonding or of mortar to a wall.

BACKGROUND OF THE INVENTION

The Austrian patent publications 344,963 and 350,237 disclose extruded ceramic exterior wall tiles for mounting with their long sides axis upright and having vertical, rectangular rounded holes, and which have U-shaped recesses at the marginal surfaces, which to the front and to the rear are delimited by the front and rear projecting tile part and in the middle or internal part are delimited by a web connecting said parts together. The head and foot marginal surfaces, which are interrupted by the holes, are essentially constituted by a simple straight cut which is perpendicular to the surface of the tile.

The disadvantages of such exterior tiles are to be more particularly seen in the fact that lateral cutting to size, frequently necessary during mounting the tiles, is not possible in a manner which is satisfactory both technically and aesthetically. Thus if an exterior wall tile is cut down to size at the side, that is to say parallel to the holes, the cut will as a rule not extend through one of a few narrow webs, but rather through one of the holes. Frequently the remaining front and rear tile parts will extend far past the two webs connecting the two parts so that the resistance of the exterior wall tile to fracture is substantially reduced. If such exterior tiles are installed with vertical spacing gaps, the small thickness of the material will be full disclosed, something undesired from the architectonic point of view. This will also be the case if—as with a tile not cut to size—the front and rear tile parts only project laterally to a slight extent and the resistance to fracture for such parts is insufficient, Further drawbacks of such exterior tiles are that the laterally projecting tile parts connecting webs and the lateral connecting webs cause a considerable braking effect on the ceramic material during extrusion and accordingly an insufficient compaction of the material. This in turn leads to an increased proneness to dry cracking, increased rates of dry breakage end a reduced resistance to fracture of the fired exterior tiles. These disadvantages are furthermore also accelerated because the marginal drying of the tiles is still further increased by the increased surface area here so that the speed of drying of the tile body is even more advanced than in a normal case.

A further drawback of such extruded exterior tiles is to be seen in the fact that owing to their straight cuts at the head and foot no satisfactory conduction or draining of water is ensured. This is more particularly significant if the exterior tiles are installed with horizontal spacing gaps, through which water on the wall and beating rain may penetrate and which also permit unobstructed viewing through as far as the supporting structure behind the tiles.

The German patent publication 3,110,606 C discloses extruded exterior tiles with round or oval holes and simple or undercut grooves, which are respectively arranged in the direction of extrusion. Exterior tiles are, to the extent that they are to be attached with their long sides horizontal, provided with an extruded hole and foot interlocking ledges for the purpose of draining away water and improving the appearance of the joins.

The tiles mounted with their long sides vertical are cut straight at the sides, that is to say perpendicularly to the holes, so that in this case a stapless horizontal adaptation to size is readily possible by cutting the exterior tiles. Should exterior tiles be installed with their long sides vertical, then they will be cut straight at the top and bottom so that poor water draining and a gaping space between the tiles will have to be tolerated. On the other hand however vertical adaptation to size is simple, because it is possible by straight cutting of the tiles. The substantial drawbacks of such exterior tiles are that stepless adaptation of the exterior tiles perpendicularly to the direction of extrusion is not possible, since then cuts as a rule extend either parallel through the holes or parallel through the grooves so that the resistance to fracture of the tiles is substantially reduced. The wall thickness, which is reduced at the positions of cutting through the holes or grooves will then be betrayed to the eye owing to open spaces between tiles. A further disadvantage of such exterior tiles is that the proportion of holes and grooves is very low with the result that their weight is relatively high. The consequence of this is that such tiles take a long time to dry during manufacture, are prone to become bent while soft and there is a high fracture rate during drying and firing. Furthermore, the supporting bracket structure necessary for installation of the tiles has to support a greater load.

Further extruded exterior tiles are disclosed in the German patent publication 3,401,271 C. They are arranged with their long sides vertical and are provided with square holes. The front and rear tile parts are connected by narrow webs extending between the holes and at the tile edge. These exterior tiles may be attached with the long sides vertical, but then with the disadvantage that owing to the straight cut transversely in relation to the holes there is poor drainage and there are gaping spaces left between the tiles. A particular drawback is however furthermore to be seen in the impossibility of stepless size adaptation transversely to the holes, since the cuts parallel to the holes which are necessary generally intersect the holes. In the case of attachment of the tiles with the long sides horizontal there is an increased chance of fracture of the downwardly over-lapping front tile part. The thinner tile portion becoming visible in the space or gap is accepted by the eye as a draining or drip sill in the case of tiles with the long sides vertical but not if they are horizontal.

A further drawback of such exterior wall tiles is to be seen in the complex configuration at the top and bottom edges due to the head and foot ledges, which as described above owing to an increased surface area and low wall thickness leads to a poor flow of the plastic ceramic material during extrusion, to excessively rapid drying at the edges and consequently to increased breakage rates and to greater lability to fracture.

One object of the invention is accordingly to provide an extruded, more particularly ceramic, exterior wall tile, which has a relatively low weight, renders possible a good stepless adaptation to size in a direction across the direction of the holes without even a single cut through one of the holes or grooves being necessary, and which furthermore ensures satisfactory drainage and is also simple and economic to produce.

SUMMARY OF THE INVENTION

The manner of attaining this aim is defined by the invention generally as indicated in FIG. 1. The advantage of this design is based on the narrow internal or middle webs which lead to a high proportion of holes in the tile and accordingly to a low weight, while however simultaneously owing to the at least doubled thickness of the marginal webs the forward extrusion flow of the plastic ceramic material from the nozzle of the extruder is improved in both marginal zones. This leads not only to an increased extrusion pressure and a higher density of the material but furthermore to enhanced bend-tension strength in the marginal zone. Owing to the collection or accumulation of material there is furthermore a welcome delay in the speed of drying in the marginal zone with the result of having reduced breakage rates during drying and firing and reduced likelihood of breakage of the exterior wall tiles. Owing to the design suggested by the present invention a completely symmetrical configuration of the cross section is possible, whose advantage is also due to the fact that the plastic ceramic material tends to be extruded out from the extruder nozzle in a practically straight form of its own accord and does not have to be forced to flow straight by braking it. Accordingly lateral distortion of the exterior wall tiles by bending out from the tile plane during drying may be substantially prevented. The exterior wall tiles in accordance with the invention can be installed or mounted with the long sides either horizontal or vertical.

In improved embodiment of the exterior wall tile in accordance with the invention as depicted in FIG. 2*a* the holes are substantially wider and the width of the marginal webs is equal to at least half the width of the holes. The advantage of this embodiment is that the proportion of holes in the exterior wall tiles is higher so that the same are lighter. In this case however the stipulation than the width of the marginal web is at least equal to half the hole width ensures that using one to at the most four cuts any desired adaptation to size is possible without intersecting with the holes. The particular advantage is that it is respectively a case of a simple straight cut through the entire thickness of the tile, that is to say a cut without any graduation. In practice in the case of a cut to the side of a hole it is necessary to leave a residual thickness of the material of approximately 2 mm in order for the aim of the invention of satisfactory stepless adaptation to size is completely achieved without cutting through holes or grooves. Accordingly the individual theoretically usable size ranges must overlap somewhat.

FIG. 2*a* indicates the individual theoretically possible size ranges by way of example as follows.

| | |
|---|---|
| $a_1 = a_2 = a_3 = a_4 =$ | 0 to 10 mm |
| $b_{1min.}$ to $b_{1\ max.} =$ | 30 to 35 mm |
| $b_1 = b_2 = b_3 = b_4 =$ | 30 to 35 mm |
| $c_{1min.}$ to $c_{1max} =$ | 55 to 60 mm |

FIGS. 2*b* and 2*c* indicate how all adaptations to size may be performed steplessly and without cutting into holes because one to four cuts are performed on one or two tiles. The same comprise the two middle or internal cuts with the size indices 1 and 2 on one and the same tile and the two outer cuts with the indices 3 and 4 in a second tile.

TABLE 1

| Ser. No. | Name of cuts | theoretically available range in mm | No. of cuts necessary | No. of tiles necessary |
|---|---|---|---|---|
| 1 | $a_1$ | 0–10 | 1 | 1 |
| 2 | $a_1 + a_2$ | 0–20 | 2 | 1 |
| 3 | $(a_1 + a_2) + (a_3 + a_4)$ | 0–40 | 4 | 2 |

TABLE 1-continued

| Ser. No. | Name of cuts | theoretically available range in mm | No. of cuts necessary | No. of tiles necessary |
|---|---|---|---|---|
| 4 | $b_1$ | 30–35 | 1 dia. = 2.0 | 1 dia. = 1.25 |
| 5 | $b_1 + a_2$ | 30–45 | 2 | 1 |
| 6 | $(b_1 + a_2) + a_3$ | 30–55 | 3 | 2 |
| 7 | $(b_1 + a_2) + (a_3 + a_4)$ | 30–65 | 4 | 2 |
| 8 | $b_1 + b_2$ | 60–70 | 2 dia. = 2.4 | 1 dia. = 1.4 |
| 9 | $(b_1 + a_2) + b_3$ | 60–80 | 3 | 2 |
| 10 | $(b_1 + a_2) + (b_3 + a_4)$ | 60–90 | 4 | 2 |
| 11 | $(c_1 + a_2) + b_3$ | 85–105 | 3 | 2 |
| 12 | $(c_1 + a_2) + (b_3 + a_4)$ | 85–115 | 4 | 2 |
| 13 | $(c_1 + b_2) + b_3$ | 105–130 | 3 | 2 |

The advantage of this design is that as may be seen from column 3 of the above table the theoretically available ranges generally overlap by 10 to 20 or at least 5 mm so that for every adaptation to size a combination of cuts is possible, in which not even one single cut has to go through the holes.

In the case of a further improved embodiment of the exterior wall tile in accordance with the invention as depicted in FIG. 3 the marginal holes have a width equal to or narrower than half the width of the holes arranged adjacent to them and equal to or narrower than the width of the marginal web. In FIG. 3 the individual ranges, which are theoretically available for adaptation to size, are represented as follows by way of example on a scale of 1:1:

| | |
|---|---|
| $a_1 = a_2 = a_3 = a_4 =$ | 0 to 10 mm |
| $b_{1min.}$ to $b_{1\ max.} =$ | 18 to 23 mm |
| $b_1 = b_2 = b_3 = b_4$ | |
| $c_{1min.}$ to $c_{1max.} =$ | 43 to 48 mm |

TABLE 2

| Ser. No. | Name of cuts | theoretically available range in mm | No. of cuts necessary | No. of tiles necessary |
|---|---|---|---|---|
| 1 | $a_1$ | 0–10 | 1 | 1 |
| 2 | $a_1 + a_2$ | 0–20 | 2 | 1 |
| 3 | $b_1$ | 18–20 | 1 | 1 |
| 4 | $b_1 + a_2$ | 18–33 | 2 dia. = 1.5 | 1 dia. = 1.0 |
| 5 | $(b_1 + a_2) + a_2$ | 18–43 | 3 | 2 |
| 6 | $b_1 + a_2$ | 36–46 | 2 | 1 |
| 7 | $c_1$ | 43–48 | 1 | 1 |
| 8 | $c_1 + a_2$ | 43–58 | 3 | 1 |
| 9 | $(c_1 + a_2) + a_3$ | 43–68 | 3 | 2 |
| 10 | $C_1 + b_2$ | 61–71 | 2 dia. = 1.9 | 1 dia. = 1.2 |

The advantage of this embodiment of the invention is that owing to the arrangement of the narrow holes in the marginal part the mean number of necessary cuts or, respectively, tiles can be reduced by 15 to 25%. Since the cuts are separately hand-cut using a diamond saw the reduction in the mean number of cuts or, respectively, tiles necessary will be a significant factor as regards economizing in installation costs. As may be seen from column 4 of the table 2 in the case of adaptations to size of 0 to 33 mm or, respectively, 0 to 70 mm on average only 1.5 or, respectively, 1.9 cuts are required, whereas in the case of the previously described embodiment with entire holes in the marginal area on average 2.0 to 2.4 cuts are necessary (see column 4 of table 1). Furthermore the mean number of necessary tiles is substantially less in the case of the improved design with 1.0 and, respectively, 1.2 tiles (see column 5 of table 2) than is the case with the previously described embodiment with 1.25 and, respectively, 1.4 tiles (see column 5 of table 1).

In the case of an embodiment in accordance with FIG. 4 the width of the holes so increases from the edge of the tiles toward the middle of the tile that the width of the respective hole is smaller than the overall size from the marginal surface of the tile as far as the respective hole. Theoretically we then have the condition: hole width≦overall size from such hole as far as the edge of the tile; for practical applications however (in order for a sufficient thickness of material to be left) the condition is: hole width<overall size. The advantage of this modified embodiment is more particularly the low weight, which is due to the high proportion of holes without the advantages of the previously described embodiment (that is to say the low mean number or cuts or, respectively, tiles necessary) being lost (see in this respect columns 4 and 5 of table 3).

In FIG. 4 the individuala ranges available for adaptation to size are represented as follows on a scale of 1:1.

| | | |
|---|---|---|
| $a_1$ = | 0 to 10 mm | $1_1$ = 8 mm < $a_{1max.}$ |
| $b_{1min.}$ to $b_{1max.}$ = | 18 to 23 mm | $1_2$ = 20 mm < $b_{1max.}$ |
| $c_{1min.}$ to $c_{1max.}$ = | 43 to 48 mm | $1_3$ = 45 mm < $c_{1max.}$ |

TABLE 3

| Ser. No. | Name of cuts | theoretically available range in mm | No. of cuts necessary | No. of tiles necessary |
|---|---|---|---|---|
| 1 | $a_1$ | 0–10 | 1 | 1 |
| 2 | $a_1 + a_2$ | 0–20 | 2 | 1 |
| 3 | $b_1$ | 18–23 | 1 | 1 |
| 4 | $b_1 + a_2$ | 18–33 | 2 dia. = 1.5 | 1 dia. = 1.0 |
| 5 | $(b_1 + a_2) + a_3$ | 18–43 | 3 | 2 |
| 6 | $c_1$ | 43–48 | 1 | 1 |
| 7 | $c_1 + a_2$ | 43–58 | 2 | 1 |
| 8 | $(c_1 + a_2) + a_3$ | 43–68 | 3 | 2 |
| 9 | $c_1 + b_2$ | 61–71 | 2 dia. = 1.9 | 1 dia. = 1.2 |

In the case of another particularly advantageous design of the exterior wall tile in accordance with the invention as depicted in FIG. 5 the width of all holes is smaller than the width of both marginal webs. The advantages are, as indicated in table 4, that the mean number of cuts necessary in no case exceeds 1.5 even in the case of major adaptations to size, that is to say it is substantially less than in the case of all preceding embodiments of the invention. Moreover, all adaptations to size can be performed on one and the same tile without a second exterior wall tile having to be employed even in some add case or other. Furthermore the systematic thinking behind the arrangement is very much easier for the craftsman on the constructional site to understand, since at the most only two cuts are to be combined instead of up to four cuts in the case of the previously described embodiments. In the case of two cuts generally the one cut through the internal web will serve essentially for producing a rough match and the cut through the wide marginal web will serve to produce an accurate fit. The advantages of the embodiment described are also relevant, if the above described wide marginal webs are to be found at both tile edges, whereas the somewhat narrower holes, made to fit them, are only arranged on one tile side. In fact if the cuts are necessary for adaption to size, the same will always be made at two opposite edges of the tile.

In FIG. 5 the described embodiment is represented by way of example on a scale of 1:1 as follows:

| | |
|---|---|
| $a_1 = a_2$ = | 0 to 22.5 mm |
| $b_1 = b_2$ = | 42.5 to 47.5 mm |
| $c_1 = c_2$ = | 67.6 to 72.5 mm |

TABLE 4

| Ser. No. | Name of cuts | theoretically available range in mm | No. of cuts necessary | No. of tiles necessary |
|---|---|---|---|---|
| 1 | $a_1$ | 0–22.5 | 1 | 1 |
| 2 | $a_1 + a_2$ | 0–45 | 2 | 1 |
| 3 | $b_1$ | 42.5–47.5 | 1 | 1 |
| 4 | $b_1 + a_2$ | 42.5–70 | 2 | 1 |
| 5 | $c_1$ | 67.5–72.5 | 1 dia. = 1.4 | 1 = dia. = 1.0 |
| 6 | $c_1 = a_2$ | 67.5–95 | 2 | 1 |

A further advantage is due to the fact that a very much smaller number of cut combinations is required in order to render possible a stepless adaption to size with full coverage of the range without cutting into the holes. Thus, as indicated in table 4, for the range of 0 to 70 mm only five cuts or cut combinations are necessary, whereas in the case of the above described embodiments as indicated in the respective tables eight to ten cuts or cut combinations are necessary. A feature which is very valuable for planning is furthermore the fact that holes of equal size may be very simply arranged in a master grid. In the case of the hole arrangement as shown in FIG. 5 with a hole width of 20 mm and internal web width of 5 mm there will be a grid of 25 mm. In the case of a gap width of 10 mm there will be a marginal web width of 22.5 mm, which is greater than the hole width of 20 mm. In order to leave a somewhat greater web thickness in the worst case for an adaption to size, it is possible, for example in the case of a 25 mm grid, to select a internal web thickness of 7 mm and a hole width of 18 mm.

The wide marginal webs have a particularly advantageous effect on the production and the quality of ceramic exterior wall tiles. Owing to the arrangement of the wide marginal webs the braking effect at the nozzle of the extrusion apparatus is reduced to be less than in the middle or internal parts so that the marginal zone of the plastic ceramic extruded material is subject to a greater pressing pressure which is responsible for a higher bend-tension strength of the material. Normally the marginal zones of tabular extruded products are less satisfactory since owing to the additional marginal area or surface there is an additional braking effect. Since the marginal parts, owing to such additional area, in any case dry more quickly and therefore shrink earlier than the middle or internal part, there is frequently the danger of drying cracks in the marginal zones, since the plate-like body possesses a reduced bend-tension strength in the marginal zone, in which it is subjected to additional shrinkage stresses owing to excessively fast drying. In the case of the tile cross section in accordance with the invention however as well owing to the build up of material in the marginal zone the speed of drying is reduced and made equal to that in the middle or internal part so that accordingly the shrinkage stress and the danger of drying cracks is substantially reduced.

Another advantageous feature of the exterior wall tile embodying the invention will be seen in FIG. 6 and is such that at its top and/or bottom marginal surface extending perpendicularly to the holes produced during extrusion the tile possesses a front and/or rear ledge or sill for drainage. The particular advantage is here that the water on the tiled wall, which will run away on the front side of the wall or facade or in the holes in the exterior wall tiles, is not able to get round to the back side or may only do so to a minor extent. Owing to draining of the water being largely restricted to the front side of the facade, only relatively small quantities of water will have to be drained from the rear side, as for instance water forced upwards by wind or condensed water so that the supporting structure and the thermal insulation will be protected against damp.

Since the ledges in FIGS. 6 and 7 are relatively prone to fracture, it is convenient to reinforce the same as indicated in FIG. 7 by such a design that the webs present between the front and rear tile parts are maintained in their full width or part thereof and owing to their connection with the ledges increase the resistance to fracture. It is convenient for the sum of the widths of the webs located at the front and rear ledge to be less than the original overall width of the webs so that they do not contact the same in the installed condition or do not mutually interfere with one another. A further advantage of the small distance between the webs is to be seen in their capillary separation, by which the outer wall water, partly running through the holes, is made to drain off toward the front drip sill.

In accordance with an even more advantageous design of the exterior wall tile in accordance with the invention illustrated in FIG. 8 the webs extend on the ledges from the rear obliquely forward and downward. The advantages thereof reside in the further increase in resistance to fracture of the ledges, since the height of the ribs on the respective ledge foot is more than twice that in the embodiment in accordance with FIG. 7. Furthermore external wall water running downward through the holes and even the water running downward on the rear side of the exterior wall tile will be drained off toward the front side of the front external wall or facade by adhesion.

Further advantageous developments and convenient forms of the invention will be understood from the following detailed descriptive disclosure of embodiments thereof in conjunction with the accompanying drawings.

DETAILED DESCRIPTION OF THE FIGURES

Figure 1:
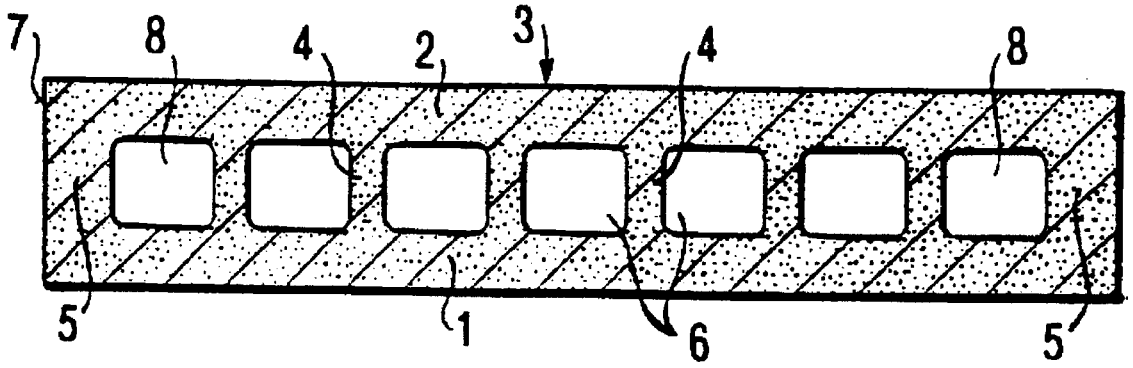
FIG. 1 shows a horizontal section taken through an exterior wall tile in accordance with the invention.

The reader will see from FIG. 1 that the front tile part 1 and the rear tile part 2 of the exterior wall tile 3 are connected together by narrow internal webs 4 and marginal webs 5 having at least twice the width thereof and that between the webs 4 and 5 rectangular holes 6 with rounded corners are provided. In this respect the marginal webs 5 present between the marginal surfaces 7 and the marginal hole 8 are at least twice as wide as the other internal webs 4.

Figure 2A:
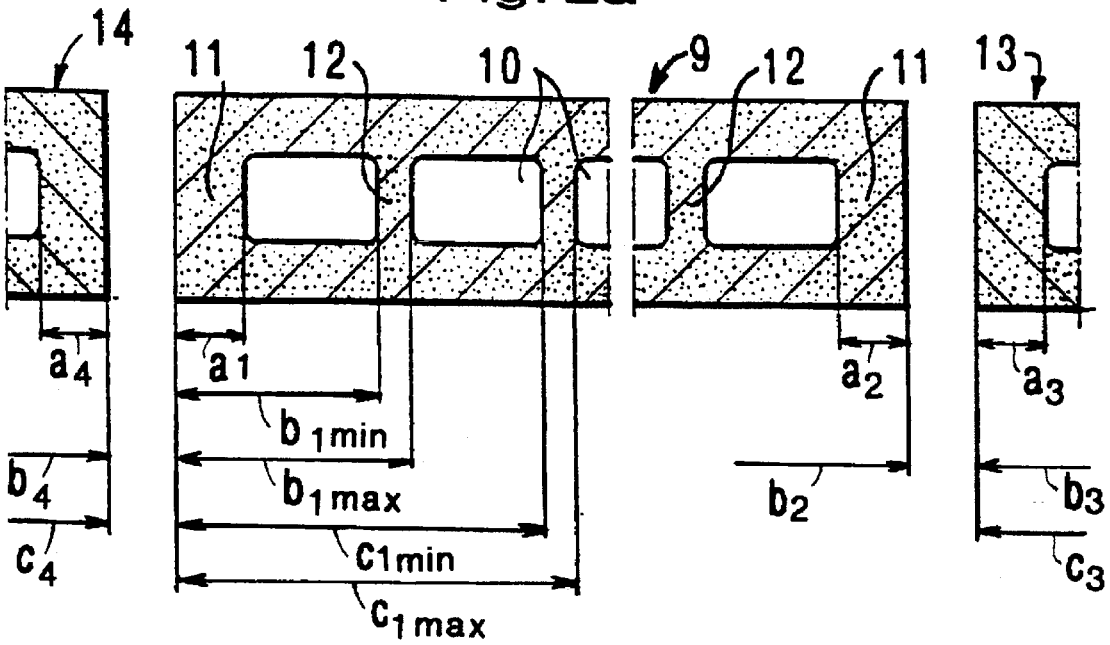
FIG. 2*a* shows a horizontal section taken through several exterior wall tiles in accordance with the invention indicating the possible sizes of cutting.

FIG. 2*a* shows an exterior wall tile 9 with rectangular, rounded off holes 10 of the same size, in the case of which the marginal webs 11 are at least twice as wide as the internal webs 12. As in FIG. 1 here as well the width $a_1$, $a_2$, $a_3$ and $a_4$ of the marginal webs is a at least as large as half the width of the holes 10. The sizes $a_1$, $a_2$, $b_{1min.}$, $b_{1max.}$, $c_{1min.}$, $c_{1max.}$ etc serve to indicate in which zones the exterior wall tiles may be cut steplessly and without intersecting the holes. The sizes $a_3$, $a_4$, $b_3$, $b_4$ etc serve to indicate in which zones, in other tiles 13 and 14, additional cuts may or must be made in order to render possible all possible adoptions to size without Intersecting the holes.

Figure 2B:
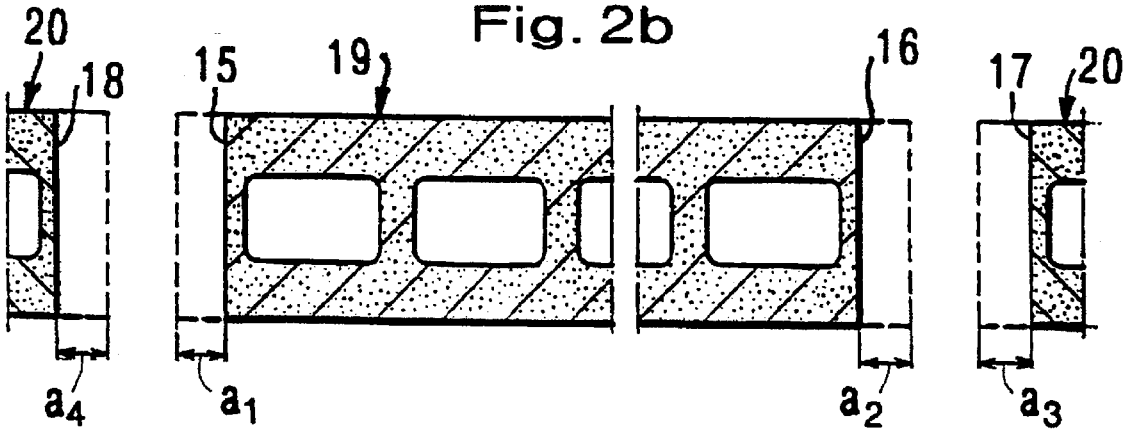
FIG. 2*b* shows a horizontal section with examples of cutting to size from 0 to 40 mm.

In FIG. 2*b* the three first forms of adaption to size are represented by one to four cuts 15, 16, 17 and 18 in one or two exterior wall tiles 19 and 20 in a stepless range of 0 through 40 mm.

Figure 2C:
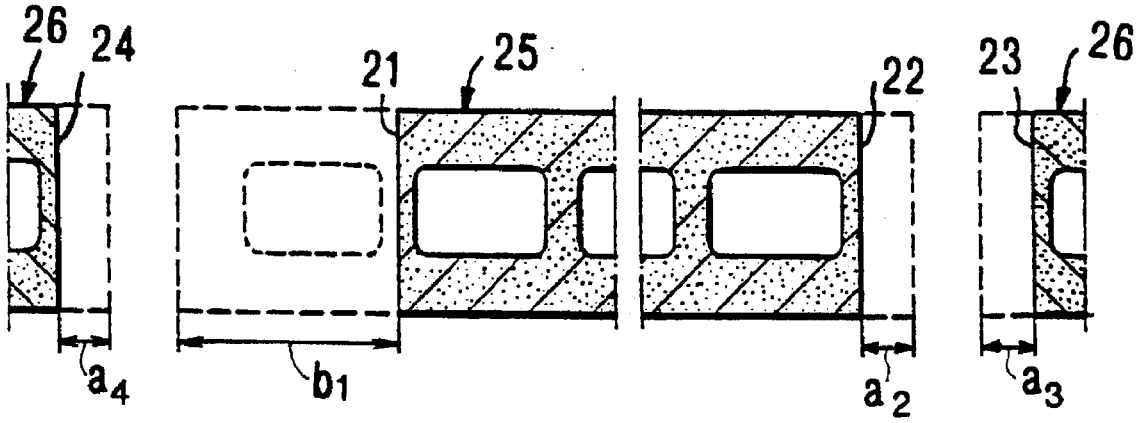
FIG. 2*c* shows a horizontal section with examples of cutting to size from 30 to 65 mm.

In FIG. 2*c* four following forms of the adaption to size are represented by one to four cuts 21, 22, 23 and 24 in one or two exterior wall tiles 25 and 26 in the stepless range of 30 to 65 mm.

Figure 3:
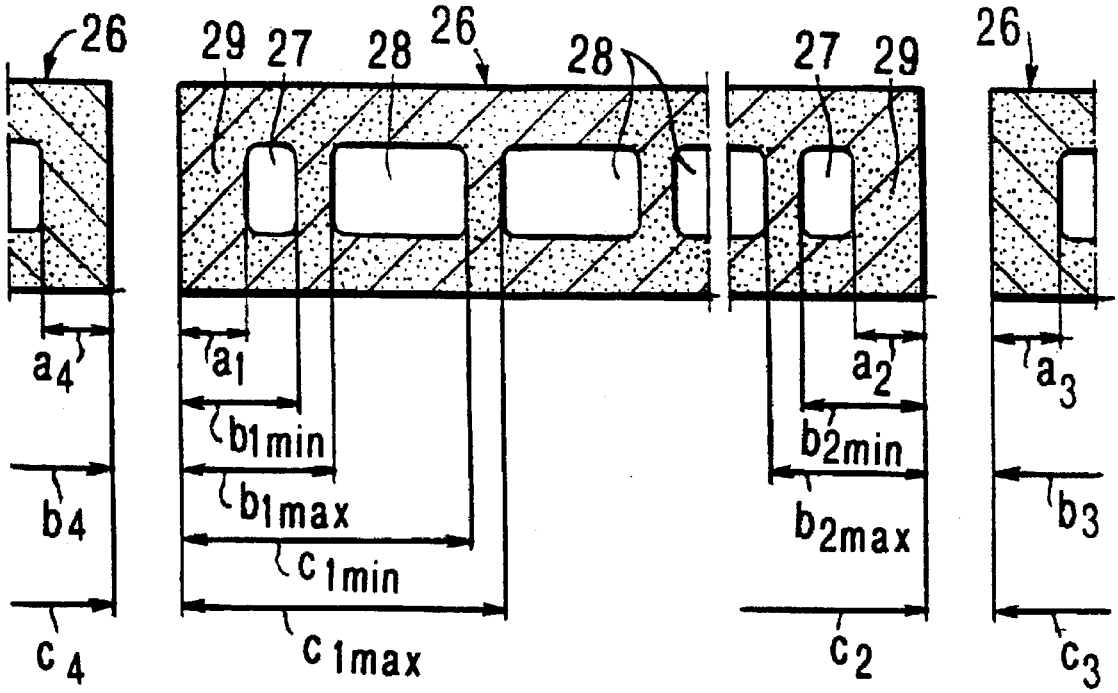
FIG. 3 shows a horizontal section taken through a plurality of exterior wall tiles with narrower marginal holes.

In FIG. 3 exterior wall tiles 26 are illustrated whose marginal holes 27 are narrower than the other holes 28 and the marginal web 29. Owing to the sizes given of $a_1$, $b_{1min.}$, $b_{1max.}$ etc there is, as also illustrated in FIG. 2*a*, an indication of the zones in which the exterior wall tile may be cut in steplessly and without intersecting the holes.

Figure 4:
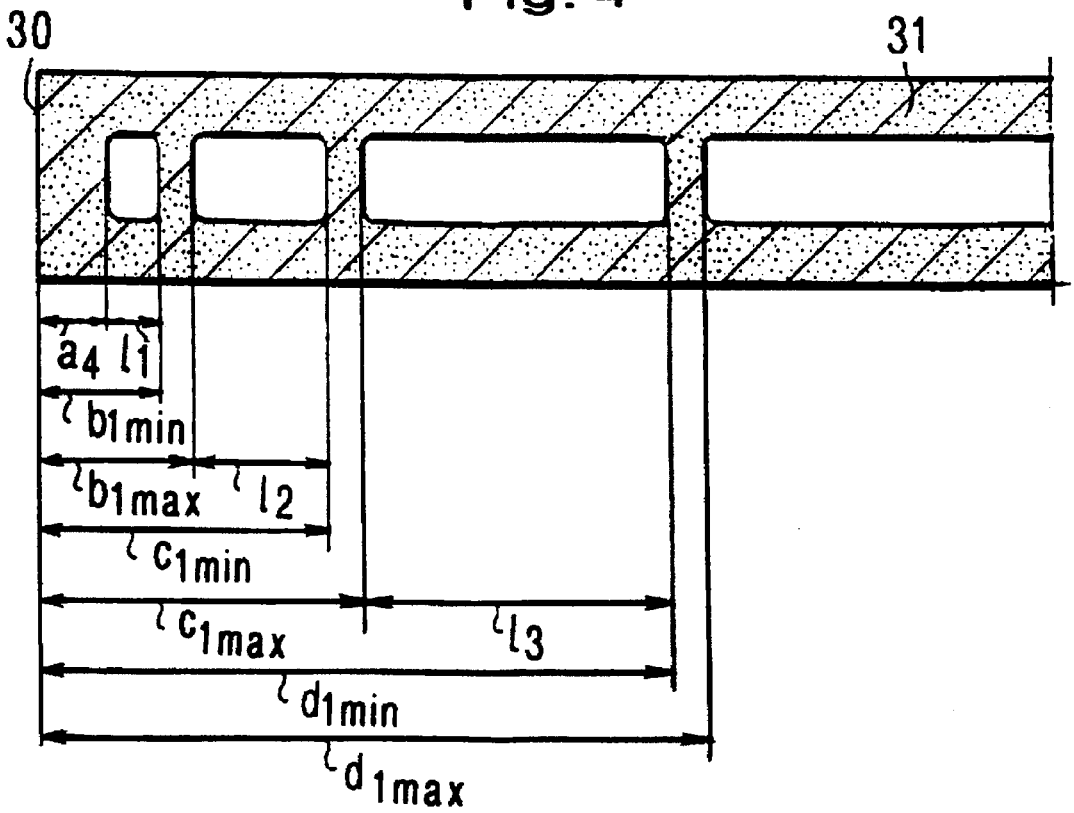
FIG. 4 shows a horizontal section taken through an exterior wall tile with increasing hole width.

FIG. 4 shows an exterior wall tile in the case of which the width the of the holes so increases from the tile's edge 30 toward the middle 31 that the respective hole width $l_2$ is for instance less than the overall size $b_{1max.}$ from the tile marginal surface as far as the respective hole.

Figure 5:
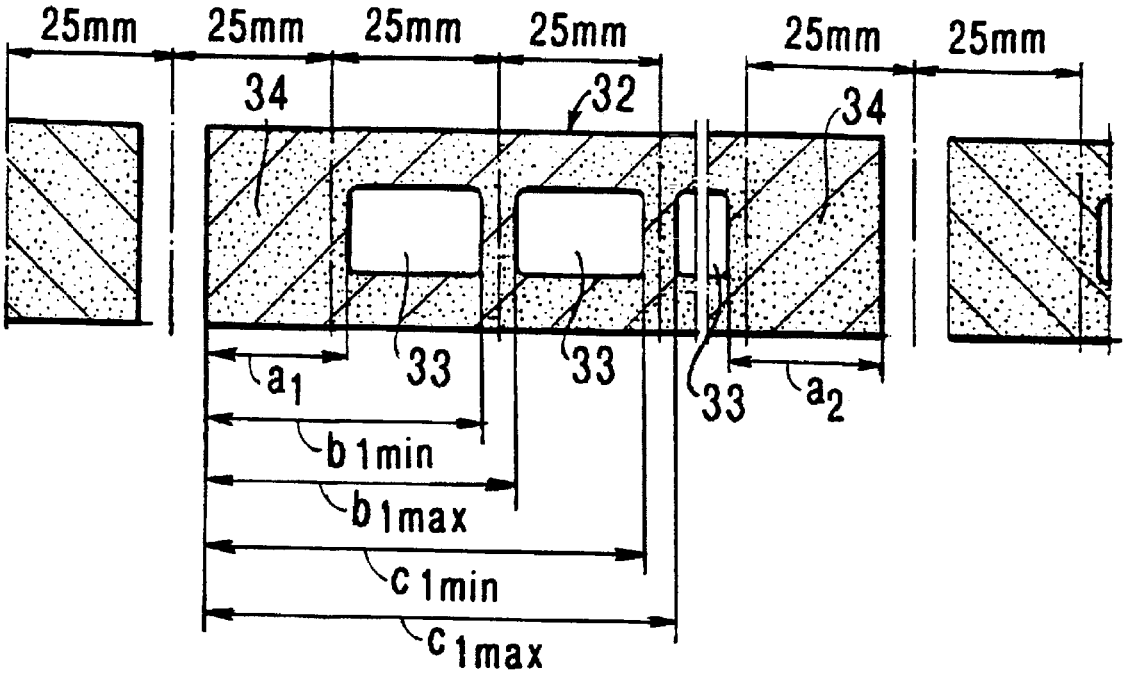
FIG. 5 shows a horizontal section taken through an exterior wall tile with a particularly wide marginal web.

FIG. 5 shows an exterior wall tile 32 in the case of which all holes 33 are of equal size and the width of the marginal webs 34 is larger than the width of the holes 33. Furthermore, the grid serving for planning and installation with a size of for instance 25 mm is indicated.

Figure 6:
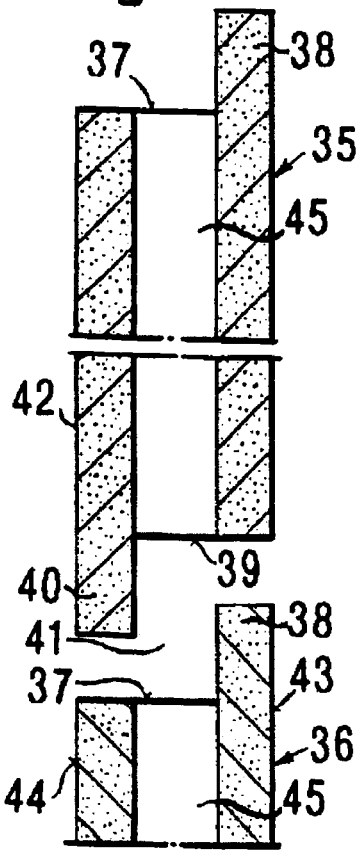
FIG. 6 shows a vertical section taken through two exterior wall tiles with ledges and without webs.

FIG. 6 shows exterior wall tiles 35 and 36 having a rear ledge 38 at their upper marginal surface 37 and a front ledge 40 at their bottom marginal surface 39, such ledges so interlocking at the horizontal tile joint 41 that external wall water draining downward on the front side 42 of the exterior wall tile 35 is not able to flow off toward the rear side 43 of the exterior wall tile 36 and instead of this it is drained off on the front side 44 or through the holes 45 in the exterior wall tile 36.

Figure 7:
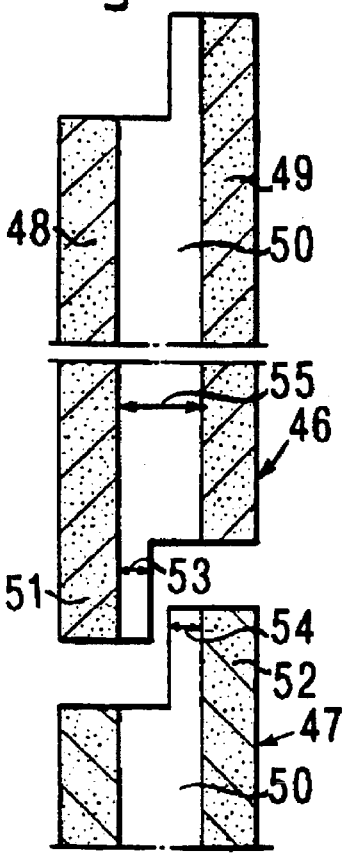
FIG. 7 shows a vertical section taken through two exterior wall tiles with remains of the webs.

FIG. 7 shows exterior wall tiles 46 and 47 whose webs 50 arranged between the front tile part 48 and the rear tile part 49 are only left with a part of their width on the front ledge 51 and the rear ledge 52. The sum of the widths 53 and 54 is less than the original width 55 of the webs 50.

Figure 8:
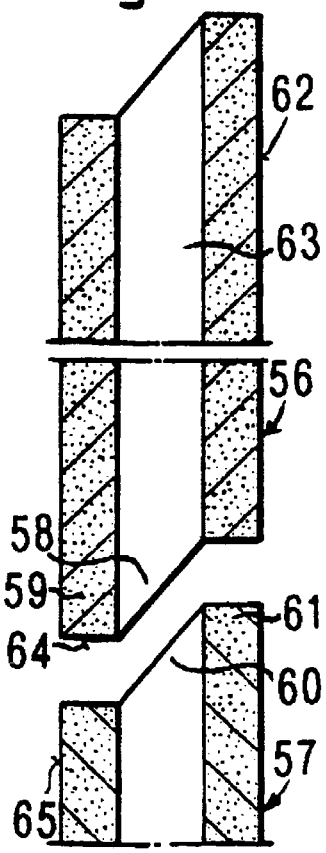
FIG. 8 is a vertical section taken through two exterior wall tiles with oblique web portions.

FIG. 8 shows exterior wall tiles 56 and 57, in the case of which both the webs 58 adjacent to the front ledge 59 and furthermore the webs 60 adjacent to the rear ledge 61 extend from behind obliquely forward and downward. Accordingly the water on the external wall, which is running along the rear side 62 of the exterior wall tiles or in the holes 63 thereof, will be drained off forward to the drip sill 64 and therefore to the front side 65 of the exterior wall tiles.

We claim:

1. An extruded bracket mountable tile for an exterior wall for back ventilated bracket mounting to an exterior wall, for constructional purposes or for decorative purposes, the tile having a marginal hole at each marginal end and internal holes, the marginal holes and internal holes extending in a direction of extrusion of the tile, wherein an exterior wall of the tile is connected together by internal webs and marginal webs and the marginal webs are arranged between marginal surfaces extending parallel to the marginal holes and the internal holes, the marginal holes and the marginal webs having a width which is at least twice that of the internal webs and a width of one or both of the marginal holes is less than or equal to half a width of the internal holes adjacent to the marginal holes and smaller than or equal to a width of the marginal web.

2. The extruded tile as claimed in claim 1, wherein a width of the internal holes increases from the marginal end of the tile toward a middle of the tile.

3. The extruded tile as claimed in claim 1, wherein the width of all or substantially all of the internal holes is less than or equal to one or both of the marginal webs.

4. The extruded tile as claimed in claim 1, wherein an upper and bottom marginal surface extending perpendicularly to the marginal holes are provided with a ledge on a rear or front side thereof.

5. The extruded tile as claimed in claim 4, wherein the ledge is reinforced by a web portion extending between the front and rear tile parts.

6. The extruded tile as claimed in claim 4, wherein the ledge is reinforced by a web portion extending from the ledge at a width less than the total width of the marginal webs.

7. The extruded tile as claimed in claim 4, wherein the ledge is reinforced by a web portion extending obliquely from the ledge.

8. The extruded tile as claimed in claim 1, wherein the tile is ceramic.

* * * * *